US010597743B2

(12) United States Patent
Guhrs et al.

(10) Patent No.: US 10,597,743 B2
(45) Date of Patent: Mar. 24, 2020

(54) PROCESS FOR PRODUCING A HIGH-GRADE STEEL TUBE AND HIGH-GRADE STEEL TUBE

(71) Applicant: SANDVIK MATERIALS TECHNOLOGY DEUTSCHLAND GMBH, Dusseldorf (DE)

(72) Inventors: Jonas Guhrs, Bielefeld (DE); Christofer Hedvall, Bielefeld (DE); Thomas Frobose, Versmold (DE); Udo Rauffmann, Werther (DE)

(73) Assignee: Sandvik Materials Technology Deutschland GmbH, Düsseldorf (DE)

( * ) Notice: Subject to any disclaimer, the term of this patent is extended or adjusted under 35 U.S.C. 154(b) by 378 days.

(21) Appl. No.: 15/500,251

(22) PCT Filed: Jul. 16, 2015

(86) PCT No.: PCT/EP2015/066280
§ 371 (c)(1),
(2) Date: Jan. 30, 2017

(87) PCT Pub. No.: WO2016/016010
PCT Pub. Date: Feb. 4, 2016

(65) Prior Publication Data

US 2018/0209005 A1 Jul. 26, 2018

(30) Foreign Application Priority Data

Jul. 31, 2014 (DE) ..... 10 2014 110 902

(51) Int. Cl.

| | |
|---|---|
| ***C21D 9/08*** | (2006.01) |
| ***C21D 8/10*** | (2006.01) |
| ***B21C 47/26*** | (2006.01) |
| ***B21C 1/00*** | (2006.01) |
| ***B21B 21/00*** | (2006.01) |
| ***C21D 6/00*** | (2006.01) |
| ***C22C 38/00*** | (2006.01) |
| ***C22C 38/04*** | (2006.01) |
| ***C22C 38/42*** | (2006.01) |
| ***C22C 38/44*** | (2006.01) |
| ***C22C 38/50*** | (2006.01) |
| ***C22C 38/52*** | (2006.01) |

(52) U.S. Cl.
CPC ..... *C21D 9/08* (2013.01); *B21B 21/005* (2013.01); *B21C 1/003* (2013.01); *B21C 47/262* (2013.01); *C21D 6/004* (2013.01); *C21D 8/105* (2013.01); *C22C 38/001* (2013.01); *C22C 38/002* (2013.01); *C22C 38/04* (2013.01); *C22C 38/42* (2013.01); *C22C 38/44* (2013.01); *C22C 38/50* (2013.01); *C22C 38/52* (2013.01); *C21D 2211/001* (2013.01)

(58) Field of Classification Search
CPC ..... C21D 9/08; C22C 38/001
USPC ..... 148/592
See application file for complete search history.

(56) References Cited

U.S. PATENT DOCUMENTS

| | | | |
|---|---|---|---|
| 3,562,031 | A | 2/1971 | Gibson |
| 2014/0054358 | A1 | 2/2014 | Andreychuk |

FOREIGN PATENT DOCUMENTS

| | | | | |
|---|---|---|---|---|
| CN | 101670520 | A | * | 3/2010 |
| CN | 101670520 | A | | 3/2010 |
| DE | 2436685 | A1 | | 7/1973 |
| DE | 3407305 | C2 | | 11/1987 |

* cited by examiner

*Primary Examiner* — Weiping Zhu
(74) *Attorney, Agent, or Firm* — Morgan, Lewis & Bockius LLP

(57) ABSTRACT

A process for producing a high-grade steel tube includes the steps of: providing a tubular blank of an austenitic high-grade steel, wherein the high-grade steel comprises in weight % no more than 0.02% carbon, no more than 1.0% manganese, no more than 0.03% phosphor, no more than 0.015% sulfur, no more than 0.8% silicon, no more than 17.5% t to 18.5% nickel, no more than 19.5% to 20.5% chromium, no more than 6.0% to 6.5% molybdenum, no more than 0.18% to 0.25% nitrogen, no more than 0.5% to 1.0% copper, and a remainder of iron and unavoidable impurities; and cold-forming the blank into a tube.

26 Claims, 1 Drawing Sheet

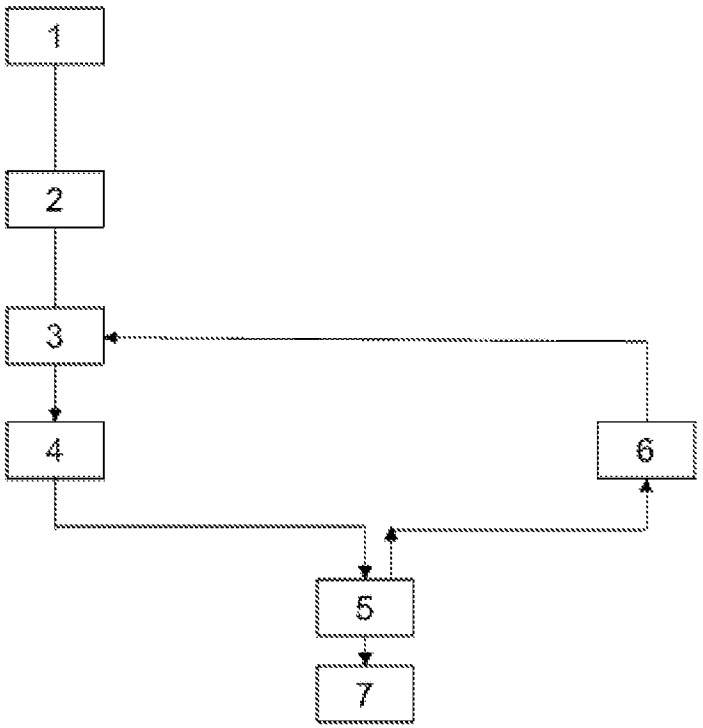
1
2
3
4
5
6
7

PROCESS FOR PRODUCING A HIGH-GRADE STEEL TUBE AND HIGH-GRADE STEEL TUBE

RELATED APPLICATION DATA

This Application is a § 371 National Stage Application of PCT International Application No. PCT/EP2015/066280 Filed Jul. 16, 2015 Claiming Priority of DE Application No. 102014110902.3, Filed Jul. 31, 2014

TECHNICAL FIELD

The present disclosure relates to a method for manufacturing a stainless steel tube with the steps: providing a tubular hollow of an austenitic stainless steel, wherein the stainless steel includes carbon in an amount of not more than 0.02 wt.-%, manganese in an amount of not more than 1.0 wt.-%, phosphor in an amount of not more than 0.03 wt.-%, sulfur in an amount of not more than 0.015 wt.-%, silicon in an amount of not more than 0.8 wt.-%, nickel in an amount from 17.5 wt.-% to 18.5 wt.-%, chromium in an amount from 19.5 wt.-% to 20.5 wt.-%, molybdenum in an amount from 6.0 wt.-% to 6.5 wt.-%, nitrogen in an amount from 0.18 wt.-% to 0.25 wt.-% as well as copper in an amount from 0.5 wt.-% to 1.0 wt.-% with a remainder of iron and unavoidable impurities, and cold forming of the hollow into a tube.

The present disclosure further relates to a stainless steel tube including carbon in an amount of not more than 0.02 wt.-%, manganese in an amount of not more than 1.0 wt.-%, phosphor in an amount of not more than 0.03 wt.-%, sulfur in an amount of not more than 0.015 wt.-%, silicon in an amount of not more than 0.8 wt.-%, nickel in an amount from 17.5 wt.-% to 18.5 wt.-%, chromium in an amount from 19.5 wt.-% to 20.5 wt.-%, molybdenum in an amount from 6.0 wt.-% to 6.5 wt.-%, nitrogen in an amount from 0.18 wt.-% to 0.25 wt.-% as well as copper in an amount from 0.5 wt.-% to 1.0 wt.-% with a remainder of iron and unavoidable impurities.

BACKGROUND

High-grade austenitic stainless steels with a high amount of molybdenum, nickel and copper are suitable for applications in sea water environments, as well as for guiding aggressive chlorine containing media.

In order to manufacture tubes of such stainless steel materials the semi-finished product, namely the hollow, is formed into a tube with defined outer and inner diameters by cold forming. However, cold forming in particular leads to a significant increase of the hardness of the tube.

In order to be able to use these tubes for the above applications they must be shipped as seamless tubes with length of the strand of 6 m or more, which complicates handling during packaging, transporting and further processing.

Furthermore, further processing, in particular for application in the off-shore field, typically requires a stranding of the completed stainless tube with other strands to form a coated bundle of tubes. However, this is opposed by the large hardness of a cold formed austenitic stainless steel tube.

SUMMARY

To overcome the above disadvantages, the present disclosure provides a method for manufacturing a tube of an austenitic stainless steel enabling stranding of the stainless tube in a further processing step and simultaneously transport of the tube to another location, where this further process step is carried out.

The present disclosure also provides a stainless steel tube, having the above required characteristics.

According to one aspect of the present disclosure, there is provided a method for manufacturing a stainless tube, comprising the steps of: providing a tubular hollow of an austenitic stainless steel, wherein the stainless steel comprises carbon in an amount of not more than 0.02 wt.-%, manganese in an amount of not more than 1.0 wt.-%, phosphor in an amount of not more than 0.03 wt.-%, sulfur in an amount of not more than 0.015 wt.-%, silicon in an amount of not more than 0.8 wt.-%, nickel in an amount from 17.5 wt.-% to 18.5 wt.-%, chromium in an amount from 19.5 wt.-% to 20.5 wt.-%, molybdenum in an amount from 6.0 wt.-% to 6.5 wt.-%, nitrogen in an amount from 0.18 wt.-% to 0.25 wt.-% as well as copper in an amount from 0.5 wt.-% to 1.0 wt.-% with a rest of iron and unavoidable impurities, cold forming of the hollow into a tube, coiling the tube and annealing the coiled tube after cold forming at a temperature in a range from 1,100° C. to 1,200° C.

Cold forming in the sense of the present disclosure considers all methods for forming, wherein the hollow, i.e. the half finished product, is formed at temperatures below the recrystallization temperature of the stainless steel used.

In the sense of the present disclosure, cold forming in particular is effected by cold pilger milling or cold drawing.

In particular for manufacturing precise tubes of stainless steel extended hollow as a half finished product, the same is cold reduced in an entirely cooled down state by compressive stress. Thereby, the hollow is formed into a tube with a defined, reduced outer diameter and a defined wall thickness or wall strength.

In order to do so in cold pilger milling, the hollow during milling is pushed over a calibrated mandrel including the inner diameter of the completed tube and thereby is grabbed from the outside by two calibrated rollers defining the outer diameter of the finished tube and milled over the mandrel in a longitudinal direction.

During cold pilger milling the hollow experiences a stepwise infeed in a direction towards the mandrel and beyond the mandrel. Between two infeed steps the rollers are rotatably moved over the mandrel and thus mill the hollow. At each point of return of the roll stand with the rollers rotatably mounted thereon, the rollers disengage the hollow and the hollow is fed by a further step towards the tool, i.e. towards the mandrel and the rollers.

The feed of the hollow over the mandrel is affected by means of a translationally driven feed clamping saddle making a translational motion in a direction parallel to the axis of the mandrel and transferring this motion to the hollow.

In addition, during the infeed the hollow is rotated around its longitudinal axis in order to allow for a uniform milling of the hollow. By milling each section of the tube multiple times a uniform wall thickness and roundness of the tube, as well as uniform inner diameter and outer diameter, are achieved. Thus, typically the infeed steps are smaller than the entire swing of the roll stand between the two points of return.

In contrast, during cold drawing as a further cold forming method considered herein, a tubular hollow is drawn through a drawing die having an inner diameter smaller than the outer diameter of the hollow and thus is formed and redimensioned.

Depending on the tool used in cold drawing of tubes, a so called hollow drawing and a so called core drawing or rod drawing are to be distinguished. In hollow drawing, the forming is effected by a drawing die (also denoted as a drawing ring), only. In core drawing or rod drawing, the inner diameter as well as the wall thickness of the drawn tube is also defined by a mandrel located in the interior of the hollow.

In the method according to the present disclosure, an austenitic stainless steel tube is used, i.e. a steel with an entirely austenitic structure at room temperature. These steels are known for their good stiffness, as well as their good corrosion resistance. The considerably high content of molybdenum, nickel, chromium and copper leads to the steel having an excellent corrosion resistance, wherein the steel simultaneously has a high tensile strength and good welding properties.

For example, an austenitic stainless steel with the given content of molybdenum, nickel and copper is available from the manufacturer Sandvik under the labelling 254 SMO. This one fulfills the quality UNS S31254 (UNS=Unified Numbering System for metals and alloys), which stands for austenitic stainless steels of the type 6 Mo.

For off-shore applications, the stainless steel tubes manufactured by cold forming have to be stranded with other strands in a plastic cladding. However, these austenitic stainless steels after cold forming have a hardness, which is too high for stranding and which may even make stranding impossible.

By soft annealing the cold formed tubes at a temperature in a range from 1,100° C. to 1,200° C. in a step following the cold forming, the hardness of the tubes may be brought back into a range allowing a stranding. According to the prior art, the soft annealing is typically effected after cold pilger milling or drawing by feeding the formed tube through an inductive heating coil. However, surprisingly, the effect of soft annealing is nullified to a large extent by a subsequent coiling or winding of the finished tube. Still, manufacturing as a ring, i.e. the tube leaves the tubing plant coiled, is necessary for the manufacturing of endless tubes having lengths of more than 6 m, in order to allow transport of the finished tubes to the location, where the stranding takes place. Further the stranding of the finished stainless steel tubes is significantly easier from a ring, i.e. coiled or wound.

Thus, according to the present disclosure, the austenitic stainless steel tube is coiled or wound prior to the annealing and is only subsequently annealed, i.e. in its coiled state.

Thus, tubes are manufactured, which in the coiled state, i.e. prior to the shipping from the tube plant, have a Rockwell hardness of 90 HRB or less, for example, of 80 HRB or less.

In one embodiment, the coiled tube is annealed at a temperature in the range from 1,115° C. to 1,155° C., for example, at a temperature in the range from 1,120° C. to 1,150° C.

If in the present disclosure it is stated that the tube is annealed at a given temperature this means that the material of the tube itself reaches this temperature.

The exact temperature in an embodiment is set such that the finished annealed and coiled tube has a Rockwell hardness of 90 HRB or less, for example, of 80 HRB or less.

By coiling of the tube in the sense of the present disclosure, either a loose coiling of the tube to form a ring without a core or a reel is considered or a coiling of the tube on a core or on a reel.

In an embodiment, the tubes manufactured this way have a length of at least 6 m, for example, of at least 12 m and/or of at least 100 m.

The tubes manufactured in an embodiment have dimensions of 6 mm×0.8 mm to 26 mm×2.5 mm (diameter×wall thickness).

It has turned out to be useful if the tube in an embodiment is annealed in the form of a coiled ring, however, without a reel or a core in the annealing furnace.

However, the finished, ready to be shipped tube in an embodiment must be coiled on a reel, for example, on a reel made of wood, in order to enable an automatic stranding at a later stage. Thus, in a further embodiment of the method according to the disclosure the coiled and already annealed tube in a further step is recoiled onto a reel, for example, onto a reel made of wood.

It is particularly useful if in an embodiment of the disclosure the tube is shipped in a coiled state.

In particular, it is useful if in an embodiment of the disclosure the coiled tube is annealed without a reel or a core at a temperature such that the tube after the annealing has a Rockwell hardness of 80 HRB or less. A temperature, which turned out to be useful for this purpose is 1,120° C. Once the tube is then coiled onto a reel, i.e. recoiled from a ring shaped condition without a core onto the reel, the tube may have a Rockwell hardness of 90 HRB or less.

In an embodiment of the disclosure, the annealing is carried out in a vacuum atmosphere, for example at a pressure of 6 mbar or less. In an alternative embodiment the tube is annealed in an inert gas atmosphere, for example, an inert gas atmosphere containing argon. Annealing in a vacuum or in an inert gas atmosphere has the advantage that the tube is not oxidized.

In an embodiment of the disclosure, the tube is annealed in a shaft furnace allowed to reach the necessary high temperatures in the material of the tube itself.

In an embodiment of the disclosure, the tube is held at a temperature in a range from 1,100° C. to 1,200° C. over a period of time of at least 5 minutes and at most 20 minutes, for example, over a period of time of about 10 minutes.

In an embodiment of the disclosure, the method after annealing of the coiled tube further includes the steps of: decoiling the tube, further cold forming of the tube, coiling of the tube and further annealing of the coiled tube at a temperature in the range from 1,100° C. to 1,200° C.

In this sequence of method steps, the first soft annealing of the cold formed tube serves to prepare for a further cold forming.

At the same time, in an embodiment of the disclosure, the tube is cold pilger milled and after a first soft annealing is cold drawn in order to reach its final dimensions. Only after this a soft annealing is affected in order to enable stranding of the tube at a later stage.

In an embodiment, the tube before annealing is degreased inside and/or outside, i.e. cleaned from lubricants. This degreasing in an embodiment is may be effected with the aid of $CO_2$.

At least one of the above objects is also achieved by a stainless steel tube including carbon in an amount of not more than 0.02 wt.-%, manganese in an amount of not more than 1.0 wt.-%, phosphor in an amount of not more than 0.03 wt.-%, sulfur in an amount of not more than 0.015 wt.-%, silicon in an amount of not more than 0.8 wt.-%, nickel in an amount from 17.5 wt.-% to 18.5 wt.-%, chromium in an amount from 19.5 wt.-% to 20.5 wt.-%, molybdenum in an amount from 6.0 wt.-% to 6.5 wt.-%, nitrogen in an amount from 0.18 wt.-% to 0.25 wt.-% as well as copper in an amount from 0.5 wt.-% to 1.0 wt.-% with a rest of iron and unavoidable impurities, wherein the stainless steel tube is coiled and in its coiled state has a hardness of less than 90 HRB, for example, of less than 80 HRB.

Thereby, the coiled stainless steel tube in an embodiment comprises a strain of at least 35%.

In particular, the stainless steel tube in an embodiment is manufactured by an embodiment of the method described above.

As far as aspects of the present disclosure have been described for the method to manufacture according to the present disclosure, the tube according to the present disclosure comprises those characteristics associated with the method applied.

The foregoing summary, as well as the following detailed description of the embodiments, will be better understood when read in conjunction with the appended drawings. It should be understood that the embodiments depicted are not limited to the precise arrangements and instrumentalities shown.

BRIEF DESCRIPTION OF THE DRAWINGS

FIG. 1 shows a flow chart of the method for manufacturing a stainless steel tube according to an embodiment of the present disclosure.

DETAILED DESCRIPTION

Referring to FIG. 1, in the present example, a hollow made of Sandvik 254 SMO material was formed into a stainless steel tube with an outer diameter of 10 mm and a wall thickness of 1.5 mm by cold pilger milling, was coiled into a ring after the cold pilger milling, wherein the ring was not coiled around a core or a reel, and was soft annealed thereafter.

The material of the hollow is a high alloyed austenitic stainless steel 254 SMO available from the company Sandvik. This steel fulfills the norm UNS S31254 (254 SMO) of the American Society of Mechanical Engineers (SME) for use in a boiler and high pressure vessel. The material Sandvik 254 SMO exemplarily used for the hollow considered here apart from iron includes 0.011 wt.-% C, 0.45 wt.-% Si, 0.56 wt.-% Mn, 0.022 wt.-% P, less than 0.001 wt.-% S, 20.13 wt.-% Cr, 17.82 wt.-% Ni, 6.09 wt.-% Mo, 0.091 Co, 0.004 wt.-% Ti, 0.51 wt.-% Cu as well as 0.2 wt.-% N.

The finished tube forms a tube as it is stranded for an off-shore application in further method steps performed outside the tubing plant to form a strand with other tubes.

The tube after cold pilger milling and coiling was annealed in the coiled state at a temperature of 1,120° C. over a period of time of approximately 10 minutes. The finished tube after cooling down has a hardness of 73 HRB to 77 HRB, a strain of approximately 41%, as well as a tensile strength Rp 0.2 of 370 MPa ($N/m^2$). Once this tube subsequently is coiled onto a reel of wood or it is recoiled from a ring without a reel onto a reel, the tube on the wooden reel has a hardness of 90 HRB or less.

In comparison, an uncoiled tube of the same material, Sandvik 254 SMO, annealed at conventional temperatures has a hardness of 96 HRB. This conventional tube thus, after coiling, which further increases the hardness, has a hardness which is significantly too hard for stranding.

For illustration, the method for manufacturing a stainless steel tube according to the present disclosure is now again briefly summarized with reference to the flow chart of FIG. 1.

First in step 1, as a raw material, a hollow of an austenitic stainless steel is provided, which in addition to iron includes 0.011 wt.-% C, 0.45 wt.-% Si, 0.56 wt.-% Mn, 0.022 wt.-% P, less than 0.001 wt.-% S, 20.13 wt.-% Cr, 17.82 wt.-% Ni, 6.09 wt.-% Mo, 0.091 Co, 0.004 wt.-% Ti, 0.51 wt.-% Cu as well as 0.2 wt.-% N. This hollow is then cold formed into the finished dimensioned tube by cold pilger milling 2.

During cold pilger milling 2 a lubricant is applied between the rollers and the tube/the hollow, as well as between the mandrel and the tube/the hollow, thus, this lubricant before annealing must be removed in two steps on the outside 3 as well as on the inside 4. Then the first annealing is effected in step 5. For particular applications, a further cold forming, e.g. by cold drawing, may be performed in step 6. After the second cold forming the steps 3 and 4, i.e. the removal of the lubricant or the degreasing, must be repeated before the tube is annealed again in step 5. After the annealing the tube in step 7 is packaged. This packaging in some embodiments means that the tube is recoiled from a ring onto a reel.

For the purpose of the original disclosure it is pointed out that all features, as they are apparent for a person skilled in the art form the present specification, from the figures and from the claims, even if they have only been described literally in combination with certain further features may be combined on their own or in arbitrary combination with other combinations of features disclosed herein, as far as those combinations are not explicitly excluded or the technical circumstances make these combinations impossible or useless. A comprehensive, explicit description of all possible combinations of features is only omitted here in order to provide a concise and readable description.

While the disclosure has been depicted and described in detail in the FIGURE and the previous description this presentation and description is only by way of an example and is not considered as a restriction of the scope of protection as it is defined by the claims. The disclosure is not restricted to the embodiments disclosed.

Variations of the disclosed embodiments are apparent for a person skilled in the art from the figures, from the description and from the attached claims. In the claims the term "comprising" does not exclude other elements or steps and the indefinite article "a" does not exclude a plurality. The mere fact that certain features are claimed in separate claims does not exclude their combination. Reference numbers in the claims are not thought to restrict the scope of protection.

The invention claimed is:

1. A method for manufacturing a stainless steel tube comprising the steps of:

providing a tubular hollow of an austenitic stainless steel, wherein the stainless steel comprises:

carbon in an amount of not more than 0.02 wt.-%, manganese in an amount of not more than 1.0 wt.-%, phosphor in an amount of not more than 0.03 wt.-%, sulfur in an amount of not more than 0.015 wt.-%, silicon in an amount of not more than 0.8 wt.-%, nickel in an amount from 17.5 wt.-% to 18.5 wt.-%, chromium in an amount from 19.5 wt.-% to 20.5 wt.-%, molybdenum in an amount from 6.0 wt.-% to 6.5 wt.-%, nitrogen in an amount from 0.18 wt.-% to 0.25 wt.-%, copper in an amount from 0.5 wt.-% to 1.0 wt.-%, and a remainder of iron and unavoidable impurities;

cold forming the hollow into a tube;

coiling the tube;

annealing the coiled tube after the cold forming at a temperature in a range from 1,100° C. to 1,200° C.; and recoiling the annealed coiled tube onto a reel without straightening the annealed coiled tube after the annealing.

2. The method according to claim 1, wherein the coiled tube is annealed at a temperature in a range from 1,115° C. to 1,155° C.

3. The method according to claim 1, wherein the temperature during annealing is such that the annealed and coiled tube has a hardness of 90 HRB or less.

4. The method according to claim 1, wherein the tube is annealed in a vacuum atmosphere at a pressure of less than 6 mbar.

5. The method according to claim 1, wherein the tube is annealed in a shaft oven.

6. The method according to claim 1, wherein annealing the coiled tube at a temperature in a range from 1,100° C. to 1,200° C., is over a period of time of at least 5 minutes and at most 20 minutes.

7. The method according to claim 1, further comprising the step of shipping the annealed coiled tube on the reel with the tube in a coiled state.

8. The method according to claim 1, wherein the tube is annealed with a tube coiled to form a ring without a reel or a core.

9. The method according to claim 1, wherein the tube is cold formed by cold pilger milling or cold drawing.

10. The method according to claim 1, wherein the coiled tube is annealed at a temperature in a range from 1,120° C. to 1,150° C.

11. The method according to claim 1, wherein the temperature during annealing is such that the annealed and coiled tube has a hardness of 80 HRB or less.

12. The method according to claim 1, wherein the tube is annealed in an inert gas atmosphere.

13. The method according to claim 1, wherein the reel is made of wood.

14. The method according to claim 1, wherein the tube is annealed in an argon containing atmosphere.

15. A method for manufacturing a stainless steel tube comprising the steps of:

cold forming a tubular hollow of an austenitic stainless steel into a first cold-formed tube;

coiling the first cold-formed tube to form a first coiled tube;

first annealing the first coiled tube at a temperature in a range from 1,100° C. to 1,200° C.;

after the first annealing, decoiling the first coiled tube to form a decoiled tube;

cold forming the decoiled tube to form a second cold-formed tube;

coiling the second cold-formed tube to form a second coiled tube;

second annealing the second coiled tube at a temperature in a range from 1,100° C. to 1,200° C.; and after the second annealing, recoiling the second coiled tube onto a reel without straightening the second annealed coiled tube, wherein the stainless steel comprises:

carbon in an amount of not more than 0.02 wt.-%, manganese in an amount of not more than 1.0 wt.-%, phosphor in an amount of not more than 0.03 wt.-%, sulfur in an amount of not more than 0.015 wt.-%, silicon in an amount of not more than 0.8 wt.-%, nickel in an amount from 17.5 wt.-% to 18.5 wt.-%, chromium in an amount from 19.5 wt.-% to 20.5 wt.-%, molybdenum in an amount from 6.0 wt.-% to 6.5 wt.-%, nitrogen in an amount from 0.18 wt.-% to 0.25 wt.-%, copper in an amount from 0.5 wt.-% to 1.0 wt.-%, and a remainder of iron and unavoidable impurities.

16. The method according to claim 15, wherein the second annealed coiled tube has a hardness of 90 HRB or less.

17. The method according to claim 15, wherein first annealing occurs in a vacuum atmosphere at a pressure of less than 6 mbar or in an inert gas atmosphere, and second annealing occurs in a vacuum atmosphere at a pressure of less than 6 mbar or in an inert gas atmosphere.

18. The method according to claim 15, wherein first annealing and second annealing occurs in a shaft oven.

19. The method according to claim 15, wherein first annealing and second annealing occurs over a period of time of at least 5 minutes and at most 20 minutes.

20. The method according to claim 15, wherein at least one of first annealing of the first coiled tube and second annealing of the second coiled tube occurs without a reel or a core.

21. The method according to claim 15, further comprising the step of shipping the recoiled second annealed coiled tube in a coiled state.

22. The method according to claim 15, wherein cold forming includes cold pilger milling or cold drawing.

23. The method according to claim 15, wherein first annealing the first coiled tube occurs without a reel or a core.

24. The method according to claim 15, wherein first annealing the first coiled tube occurs in an inert gas atmosphere.

25. The method according to claim 24, wherein second annealing the second coiled tube occurs in an inert gas atmosphere.

26. The method according to claim 25, wherein the inert gas atmosphere contains argon.

* * * * *